US009368068B2

(12) United States Patent
Kaplan et al.

(10) Patent No.: US 9,368,068 B2
(45) Date of Patent: Jun. 14, 2016

(54) PIXEL CIRCUIT AND DISPLAY DEVICE USING THE SAME

(71) Applicant: Samsung Display Co., Ltd., Yongin (KR)

(72) Inventors: Leonid Kaplan, Yongin (KR); Heung-Yeol Na, Yongin (KR); Baek-Woon Lee, Yongin (KR); Won-Sik Hyun, Yongin (KR); Jae-Hoon Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 183 days.

(21) Appl. No.: 14/248,050

(22) Filed: Apr. 8, 2014

(65) Prior Publication Data

US 2015/0054718 A1 Feb. 26, 2015

(30) Foreign Application Priority Data

Aug. 22, 2013 (KR) ..... 10-2013-0099807

(51) Int. Cl.
*G09G 3/30* (2006.01)
*G09G 3/32* (2016.01)
*G09G 3/20* (2006.01)

(52) U.S. Cl.
CPC ..... *G09G 3/3258* (2013.01); *G09G 3/2022* (2013.01); *G09G 2300/0857* (2013.01)

(58) Field of Classification Search
CPC ..... H05B 33/0896; G09G 3/3258; G09G 3/2022; G09G 2300/0857; G09G 3/3674; G09G 3/3233; G09G 3/30; G09G 2300/30857
USPC ..... 345/76–77; 315/291
See application file for complete search history.

(56) References Cited

U.S. PATENT DOCUMENTS 6,809,482 B2 10/2004 Koyama
8,786,587 B2 * 7/2014 Kang ..... G09G 3/3233 345/211

(Continued)

FOREIGN PATENT DOCUMENTS

KR 10-2001-0016901 3/2001
KR 10-2004-0063364 7/2004

(Continued)

OTHER PUBLICATIONS

A.Tagawa, et al., "A Novel Digital-Gray-Scale Driving Method with a Multiple Addressing Sequence for AM-OLED Displays," AMD3/OLED5-2, pp. 279-282, Proc. IDW, 2004, Japan.

*Primary Examiner* — Aneeta Yodichkas
*Assistant Examiner* — Gerald Oliver
(74) *Attorney, Agent, or Firm* — H.C. Park & Associates, PLC

(57) ABSTRACT

Exemplary embodiments of the present invention relate to a pixel circuit comprising an organic light emitting diode (OLED), an RS trigger comprising a first terminal connected to a scan line, a second terminal connected to an enable line, and a third terminal connected to a data line, the RS trigger configured to generate an output signal according to an enable signal, a data signal, and a scan signal respectively received via the enable line, the data line, and the scan line, and a driving transistor comprising a first electrode connected to a first power source, a second electrode connected to an anode of the OLED, and a gate electrode connected to an output terminal of the RS trigger, the driver transistor configured to control a current flowing through the OLED in response to the output signal of the RS trigger.

18 Claims, 3 Drawing Sheets

(56) References Cited

U.S. PATENT DOCUMENTS

| | | | | |
|---|---|---|---|---|
| 2005/0035958 | A1* | 2/2005 | Moon | G09G 3/3674 345/204 |
| 2011/0115772 | A1* | 5/2011 | Chung | G09G 3/3233 345/211 |
| 2011/0115835 | A1* | 5/2011 | Lee | G09G 3/3233 345/691 |

FOREIGN PATENT DOCUMENTS

| | | |
|---|---|---|
| KR | 10-2005-0094017 | 9/2005 |
| KR | 10-2007-0050618 | 5/2007 |
| KR | 10-2007-0118386 | 12/2007 |
| KR | 10-2008-0003100 | 1/2008 |
| KR | 10-2009-0113079 | 10/2009 |
| KR | 10-2009-0113080 | 10/2009 |

* cited by examiner

| SF | SF1 | SF2 | SF3 | SF4 | SF5 | SF6 | SF7-1 | SF7-2 | SF8-1 | SF8-2 | SF8-3 | SF8-4 |
|---|---|---|---|---|---|---|---|---|---|---|---|---|
| TIME | 1 | 2 | 4 | 8 | 16 | 32 | 32 | 32 | 32 | 32 | 32 | 32 |

PIXEL CIRCUIT AND DISPLAY DEVICE USING THE SAME

CROSS-REFERENCE TO RELATED APPLICATION

This application claims priority from and the benefit of Korean Patent Application No. 10-2013-0099807, filed on Aug. 22, 2013, which is hereby incorporated by reference for all purposes as if fully set forth herein.

BACKGROUND

1. Field

Exemplary embodiments of the present invention relate to a pixel circuit and a display device using the pixel circuit. More particularly, exemplary embodiments of the present invention relate to a pixel circuit that can be driven at a high speed and display an image of uniform luminance, and a display device using the pixel circuit.

2. Discussion of the Background

Various kinds of flat display devices developed in recent years are capable of reducing detriments of cathode ray tubes (CRT), such as their heavy weight and large size. Examples of flat panel displays are a liquid crystal display (LCD), a field emission display (FED), a plasma display panel (PDP), an organic light emitting diode (OLED) display, and the like.

Among the flat panel displays, the organic light emitting diode display which uses an organic light emitting diode (OLED), generates light by recombining electrons and holes, has a fast response speed, is driven with low power consumption, and has excellent emission efficiency, luminance, and viewing angle, such that it has recently been in the limelight.

In general, a plurality of pixels emitting light in the organic light emitting diode (OLED) display include an organic light emitting diode (OLED), and the organic light emitting diode (OLED) generates light of a predetermined luminance corresponding to a data current supplied from a pixel circuit.

Digital driving, which is one method of expressing grayscale of the organic light emitting diode display, controls an on time of a pixel. When the digital driving is used in the organic light emitting diode, one frame is divided into a plurality of sub-frames, and a light emitting period of each sub-frame is set in order to display grayscale. Among a plurality of sub-frames constituting one frame, the pixel emits light during the selected sub-frame depending on an image signal for grayscale expression. That is, the sub-frame is selected according to the image signal, and is turned on to express the grayscale.

The above information disclosed in this Background section is only for enhancement of understanding of the background of the invention and therefore it may contain information that does not form the prior art that is already known in this country to a person of ordinary skill in the art.

SUMMARY

Exemplary embodiments of the present invention provide a pixel circuit having advantages of facilitating a high-speed drive by reducing a data writing time thereof.

Exemplary embodiments of the present invention also provide a high-definition large-screen display device having advantages of displaying an image of uniform luminance.

Additional features of the invention will be set forth in the description which follows, and in part will be apparent from the description, or may be learned by practice of the invention.

An exemplary embodiment of the present invention discloses pixel circuit comprising an organic light emitting diode (OLED), an RS trigger comprising a first terminal connected to a scan line, a second terminal connected to an enable line, and a third terminal connected to a data line, the RS trigger configured to generate an output signal according to an enable signal, a data signal, and a scan signal respectively received via the enable line, the data line, and the scan line, and a driving transistor comprising a first electrode connected to a first power source, a second electrode connected to an anode of the OLED, and a gate electrode connected to an output terminal of the RS trigger, the driver transistor configured to control a current flowing through the OLED in response to the output signal of the RS trigger.

An exemplary embodiment of the present invention also discloses a display device comprising a scan driver configured to generate a scan signal and apply the scan signal to at least one scan line, a data driver configured to generate a data signal and apply the data signal to at least one data line, an enable driver configured to generate an enable signal and apply the enable signal to at least one enable line, a controller configured to control the scan driver, the data driver, and the enable driver, and at least one pixel circuit comprising an organic light emitting diode (OLED), an RS trigger comprising a first terminal connected to a scan line, a second terminal connected to an enable line, and a third terminal connected to a data line, the RS trigger configured to generate an output signal according to an enable signal, a data signal, and a scan signal respectively received via the enable line, the data line, and the scan line, and a driving transistor comprising a first electrode connected to a first power source, a second electrode connected to an anode of the OLED, and a gate electrode connected to an output terminal of the RS trigger, the driver transistor configured to control a current flowing through the OLED in response to the output signal of the RS trigger, wherein the at least one pixel circuit is disposed between the at least one scan line, the at least one data line, and the at least one enable line. It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
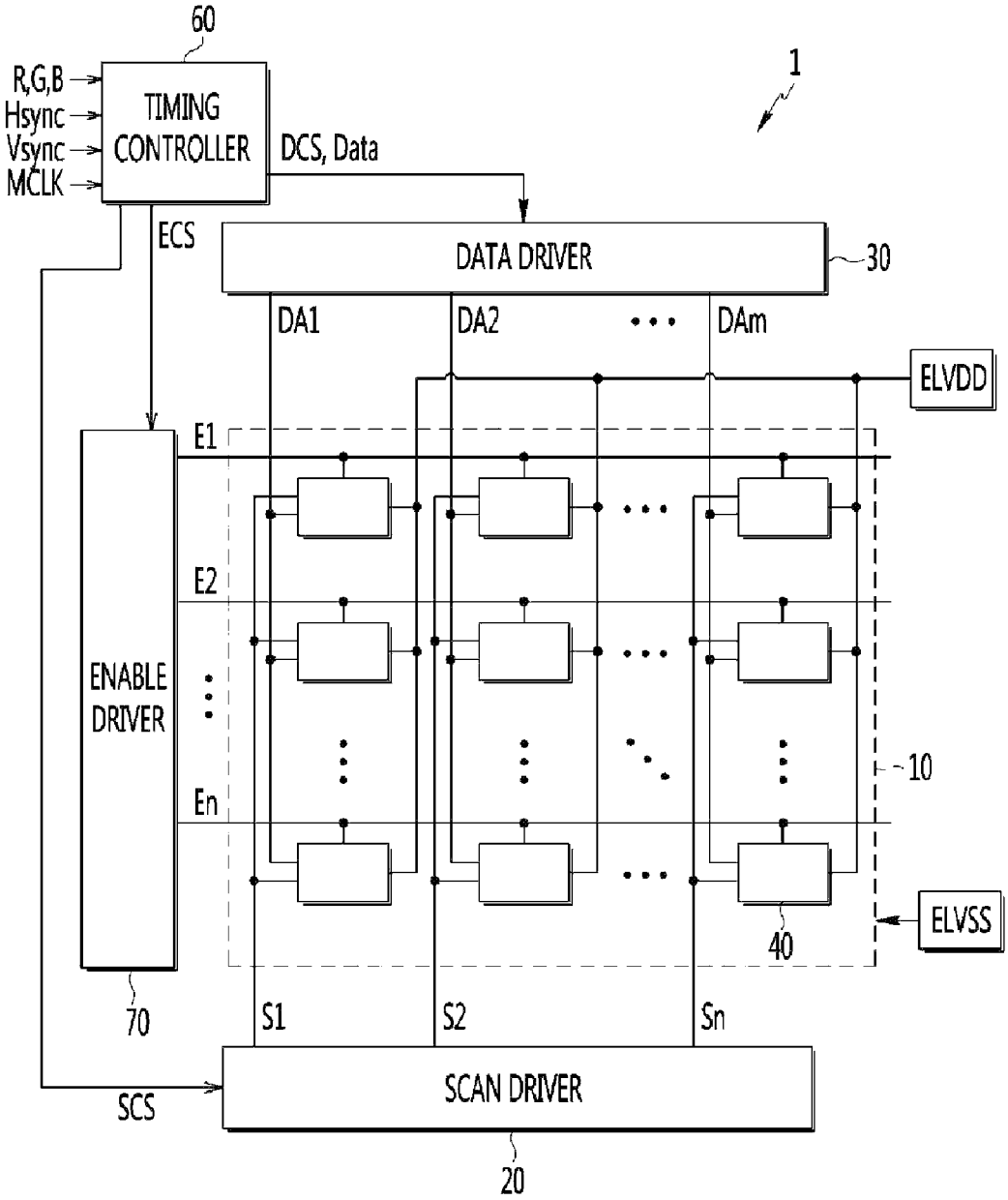
FIG. 1 is a block diagram showing a display device in accordance with an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention.

Further, constituent elements having the same configurations in the exemplary embodiments are exemplarily described in a first exemplary embodiment using like reference numerals, and only different configurations from those in the first exemplary embodiment will be described in other exemplary embodiments.

In the drawings and this specification, parts or elements that are not related to the description hereof are omitted in order to clearly describe the present invention, and the same or like constituent elements are designated by the same reference numerals throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a block diagram showing a display device in accordance with an exemplary embodiment of the present invention.

Referring to FIG. 1, the display device 1 of the present exemplary embodiment includes: a display 10 including a plurality of pixels 40 connected to a plurality of scan lines S1 to Sn, a plurality of data lines DA1 to DAm, and a plurality of enable lines E1 to En; a scan driver 20 for applying a scan signal to the pixels 40 through the scan lines S1 to Sn; a data driver 30 for applying data signals to the pixels 40 through the data lines D1 to Dam; an enable driver 70 for applying enable signals to the pixels through the enable lines E1 to En; and a timing controller 60 for controlling the scan driver 20, the data driver 30, and the enable driver 70.

The pixels 40 are powered by a first power source ELVDD and a second power source ELVSS, located outside the display device 1. Each of the pixels 40 supply currents to an organic light emitting diode (OLED) according to corresponding data signal, and the OLED emits light with luminance according to the currents.

The timing controller 60 receives image signals R, G, and B from an external device and an input control signal for controlling displaying of the image signals. The image signals R, G, and B include luminance information of the corresponding pixels 40, and the luminance information includes corresponding grayscale data in, for example, 1024 ($2^{10}$), 256 ($2^8$), or 64 ($2^6$) grayscales. The input control signals include a vertical synchronization signal Vsync, a horizontal synchronization signal Hsync, and a main clock signal MCLK.

The timing controller 60 processes the image signals R, G, and B to meet the operational conditions of the display 10 and the data driver 30 based on the image signals R, G, and B and the input control signal, and generates a data control signal DCS, a scan control signal SCS, and an enable control signal ECS. The data control signal DCS is supplied to the data driver 30, the scan control signal SCS is supplied to the scan driver 20, and the enable control signal ECS is supplied to the enable driver 70.

The timing controller 60 divides the frame of the image signals R, G, and B into a plurality of sub-frames SF and determines driving methods of the pixels 40.

Figures 2, 3:
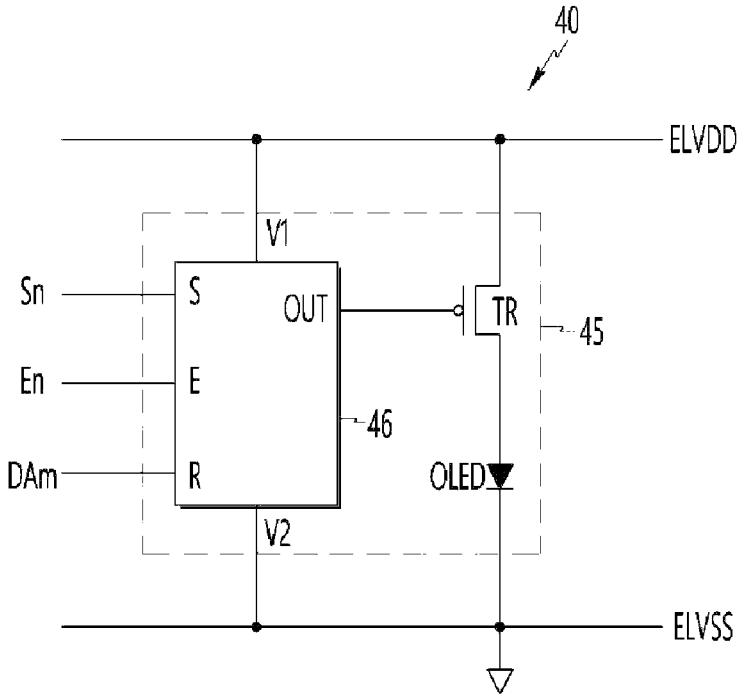
FIG. 2 shows a pixel circuit in accordance with the present exemplary embodiment.
FIG. 3 shows sub-frames constituting a digital-driven frame in accordance with the present exemplary embodiment.

FIG. 3 shows sub-frames constituting a digital-driven frame in accordance with the present exemplary embodiment.

The sub-frames of FIG. 3 are arranged in order from a sub-frame 1 SF1 to a sub-frame 8-4 SF8-4, and in detail, in an ascending order of sub-frame 1 SF1, sub-frame 2 SF2, sub-frame 3 SF3, sub-frame 4 SF4, sub-frame 5 SF5, sub-frame 6 SF6, sub-frame 7-1 SF7-1, sub-frame 7-2 SF7-2, sub-frame 8-1 SF8-1, sub-frame 8-2 SF8-2, sub-frame 8-3 SF8-3, and sub-frame 8-4 SF8-4. A light emitting period for expressing a grayscale is allocated to each sub-frame, and the light emitting periods corresponding to the respective sub-frames are shown on the bottom row of the table of FIG. 3.

According to the present digital driving method, one frame is divided into a plurality of sub-frames, and grayscale is expressed by turning on a sub-frame selected according to the image signal for one frame period. For example, to express the grayscale 12, the sub-frame 3 SF3 having four light emitting periods and the sub-frame 4 SF4 having eight light emitting periods may be turned on for one frame period. To express grayscale 127, all of the sub-frame 1 SF1 to the sub-frame 7-2 SF7-2 may be turned on for one frame period. To express grayscale 128, all of the sub-frame 8-1 SF8-1 to the sub-frame 8-4 SF8-4 may be turned on for one frame period.

The data driver 30 applies a plurality of data signals to the data lines DA1 to DAm for the sub-frames SF included in one frame according to the data control signal DCS.

Specifically, the data driver 30 is synchronized with a time point when a scan signal having a gate-on voltage corresponding to each of the sub-frames is applied, and applies a plurality of data signals through the data lines DA1 to Dam, to control whether or not the pixels 40 should emit light. The gate-on voltage signifies a voltage level for turning on a driving transistor TR which transmits a current to the OLED, as will be described below with reference to a pixel configuration of FIG. 2.

The scan driver 20 is synchronized with a starting point of each sub-frame SF, and applies a scan signal having a gate-on voltage to a corresponding scan line among the scan lines S1 to Sn. Accordingly, the pixels 40 that are connected to the corresponding scan line are selected. The pixels 40 selected by the scan signal receive the data signal from the data lines DA1 to DAm according to the corresponding sub-frame. Herein, the corresponding sub-frame refers to a sub-frame that corresponds to the scan signal having a gate-on voltage.

The first power source ELVDD and the second power source ELVSS supply two driving voltages for the operation of the pixels 40. The two driving voltages include a high-level driving voltage supplied from the first power source ELVDD and a low-level driving voltage supplied from the second power source ELVSS. In some exemplary embodiments, the first power source ELVDD or the second power source ELVSS may be a ground.

FIG. 2 shows a pixel circuit in accordance with the present exemplary embodiment. More specifically, FIG. 2 shows a pixel circuit 45 of a pixel 40 connected to an mth scan line Sn, an mth data line DAm, and an nth enable line En, among the pixels 40 of FIG. 1.

Referring to FIG. 2, the pixel circuit 45 of the present exemplary embodiment controls a current amount supplied to the OLED in response to a data signal applied to the data line DAm when a scan signal is applied to the scan line Sn. The pixel circuit 45 includes a driving transistor TR, an RS trigger 46, and an OLED. FIG. 2 shows one exemplary embodiment of the driving circuit of the pixel, but the embodiment is not restricted to the above-described embodiment, and other known configurations of the pixel circuit in the corresponding field are applicable in various ways.

The driving transistor TR includes a gate electrode connected to an output terminal OUT of the RS trigger 46, a source electrode connected to the first power source ELVDD, and a drain electrode connected to an anode of the OLED.

When a low-level output signal of the RS trigger 46 is applied to a gate electrode of the driving transistor TR, the driving transistor RS is turned on. Accordingly, a voltage difference between the gate electrode and the source electrode of the driving transistor TR equals a voltage difference between the data signal and a first driving voltage from the first power source ELVDD, and the voltage difference between the source electrode and the gate electrode may drive current flow in the driving transistor TR according to the voltage difference. The driving current is transferred to the OLED, and the OLED emits light according to the transferred driving current.

The driving transistor TR in present exemplary embodiment is described as a PMOS transistor. The driving transistor TR may also be formed of a NMOS transistor, a CMOS transistor, or a combination thereof.

The anode electrode of the OLED is connected to the drain electrode of the driving transistor TR, and the cathode electrode thereof is connected to the second power source ELVSS. The OLED emits light according to the driving current flowing through the driving transistor TR.

The RS trigger 46 includes a reset terminal R, a set terminal S, an enable terminal E, an output terminal OUT, a first power source terminal V1, and a second power source terminal V2.

The set terminal S is connected to the corresponding scan lines scan lines Sn, the reset terminal R is connected to the corresponding data lines DAm, and the enable terminal E is connected to the corresponding enable lines En.

A first driving voltage of a high level supplied from the first power source ELVDD is applied to the first power source terminal V1, and a second driving voltage of a low level supplied from the second power ELVSS is applied to the second power source terminal V2.

The output terminal OUT is connected to the gate electrode of the driving transistor TR to apply an output value of the RS trigger 46 to the gate electrode of the driving transistor TR.

When a plurality of scan signals having gate-on voltage levels are applied to a corresponding scan line, the corresponding scan signal is applied to the RS trigger 46 connected to the corresponding scan line through the set terminal S.

When a plurality of data signals are applied to a corresponding data line among the data lines DA1 to Dam, the corresponding data signal is applied to the RS trigger 46 connected to the corresponding data line through the reset terminal R.

Figure 4:
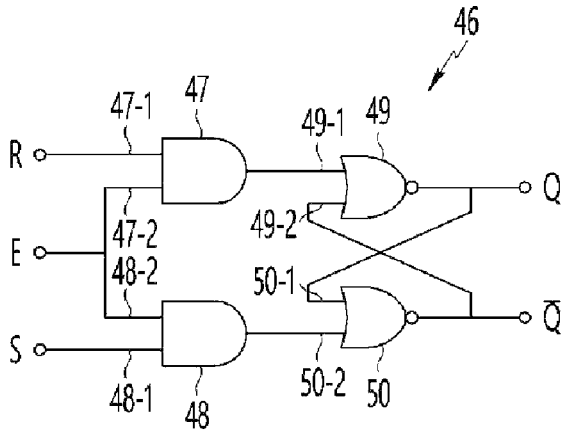
FIG. 4 shows an RS trigger in accordance with the present exemplary embodiment.

FIG. 4 shows an RS trigger 46 in accordance with the present exemplary embodiment.

The RS trigger 46 in accordance with the present exemplary embodiment includes a first AND gate 47, a second AND gate 48, a first NOR gate 49, and a second NOR gate 50.

A first input terminal 47-1 of the first AND gate 47 is connected to the reset terminal R to receive a data signal from the data line DAm. A second input terminal 47-2 of the first AND gate 47 is connected to the enable terminal E to receive an enable signal from the enable line En.

A first input terminal 48-1 of the second AND gate 48 is connected to the set terminal S to receive a scan signal from the scan line Sn. A second input terminal 48-2 of the second AND gate 48 is connected to the enable terminal E to receive an enable signal from the enable line En.

A first input terminal 49-1 of the first NOR gate 49 is connected to an output terminal of the first AND gate 47 to receive an output signal of the first AND gate 47. A second input terminal 49-2 of the first NOR gate 49 is connected to an output terminal of the second NOR gate 50 to receive an output signal of the second NOR gate 50.

A first input terminal 50-2 of the second NOR gate 50 is connected to an output terminal of the second AND gate 48 to receive an output signal of the second AND gate 48. A second input terminal 50-1 of the second NOR gate 50 is connected to an output terminal of the first NOR gate 49 to receive an output signal of the first NOR gate 49.

The output characteristics of the RS trigger 46 in accordance with the present exemplary embodiment are shown in the following Table 1.

TABLE 1

| S | R | Q |
|---|---|---|
| 0 | 0 | Previous state |
| 0 | 1 | 0 |
| 1 | 0 | 1 |
| 1 | 1 | Not available |

When a high-level signal is applied to the enable terminal E of the RS trigger 46, an output of the RS trigger 46 is determined according to signals applied to the set terminal S and the reset terminal R. When a low-level signal is applied to the enable terminal E, the output generated by the RS trigger 46 when the high-level signal is applied to the enable terminal E is maintained.

Hereinafter, the case when the high-level signal is applied to the enable terminal E will be described. As shown in Table 1, when low-level signals are applied to the set terminal S and the reset terminal R of the RS trigger 46 in accordance with the present exemplary embodiment, the previous output is outputted to the output terminal OUT as it is.

When a low-level signal is applied to the set terminal S and a high-level signal is applied to the reset terminal R, a low-level signal is outputted to the output terminal OUT.

When a high-level signal is applied to the set terminal S and a low-level signal is applied to the reset terminal R, a high-level signal is outputted to the output terminal OUT.

There is no case when high-level signals are applied to the set terminal S and the reset terminal R.

Figure 5:
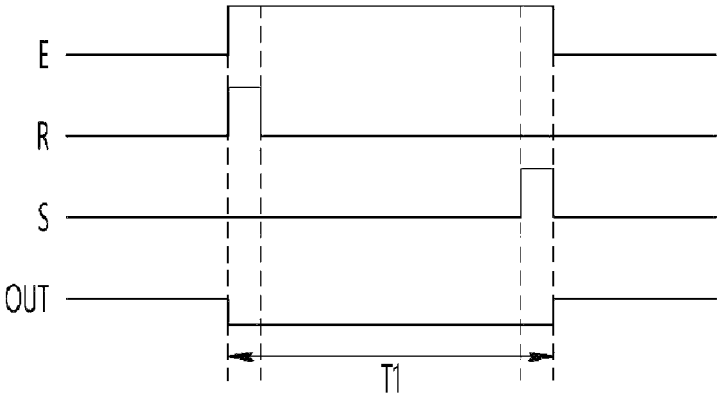
FIG. 5 shows a driving timing of the RS trigger in accordance with the present exemplary embodiment.

FIG. 5 shows driving timing of the RS trigger 46 in accordance with the present exemplary embodiment.

A high-level enable signal is applied to the enable terminal E of an RS trigger 46 of a corresponding pixel during a light-emission period T1 of a corresponding sub-frame (SF) according to an enable control signal (ESC).

When a high-level signal is first applied to the reset terminal R of the RS trigger 46 of the corresponding pixel according to a data control signal (DCS), and a low-level signal is applied to the set terminal S of the RS trigger 46 in the pixel according to a scan control signal (SCS), a low-level signal is outputted to the output terminal OUT of the RS trigger 46. The low-level signal of the output terminal OUT of the RS trigger 46 is applied to the gate terminal of the driving transistor TR to turn on the driving transistor TR, and thus a driving current starts to flow into the OLED, and the OLED starts to emit light.

In this state, when the low-level signal is applied to the reset terminal R, the output of the reset terminal is maintained. The low-level signal is outputted to the output terminal OUT of the RS trigger 46 to maintain the light emission of the OLED.

Thereafter, when a high-level signal is first applied to the set terminal S of the RS trigger 46 of a corresponding pixel according to a scan control signal SCS, and a low-level signal is applied to the reset terminal R of the RS trigger 46 in the pixel according to a data control signal DCS, a high-level signal is outputted to the output terminal OUT of the RS trigger 46. The high-level signal of the output terminal OUT of the RS trigger 46 is applied to the gate terminal of the driving transistor TR and turns off the driving transistor TR, and thus the OLED does not emit light.

The present invention has an effect of facilitating high-speed driving by reducing a data writing time thereof. The present invention also has effect of enabling a high-definition large-screen display device to display an image of uniform luminance.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A pixel circuit comprising:

an organic light emitting diode (OLED);

an RS trigger comprising a first terminal connected to a scan line, a second terminal connected to an enable line, and a third terminal connected to a data line, the RS trigger configured to generate an output signal according to an enable signal, a data signal, and a scan signal respectively received via the enable line, the data line, and the scan line; and a driving transistor comprising a first electrode connected to a first power source, a second electrode connected to an anode of the OLED, and a gate electrode connected to an output terminal of the RS trigger, the driver transistor configured to control a current flowing through the OLED in response to the output signal of the RS trigger.

2. The pixel circuit of claim 1, wherein the RS trigger is further configured to output the output signal according to signals applied respectively to the first terminal and the third terminal, when the enable signal of a first level is applied to the second terminal of the RS trigger.

3. The pixel circuit of claim 2, wherein the RS trigger is further configured to maintain a previous output signal when the enable signal of the first level is applied to the second terminal of the RS trigger, and signals of a second level are respectively applied to the first terminal and the third terminal.

4. The pixel circuit of claim 2, wherein the RS trigger is further configured to output a signal of low-level when the enable signal of the first level is applied to the second terminal of the RS trigger, and a signal of a second level is applied to the first terminal and a signal of the first level is applied to the third terminal.

5. The pixel circuit of claim 2, wherein the RS trigger is further configured to output a signal of a high level when the enable signal of the first level is applied to the second terminal of the RS trigger, and a signal of the first level is applied to the first terminal and a signal of a second level is applied to the third terminal.

6. The pixel circuit of claim 2, wherein the RS trigger further comprises:

a first logic circuit comprising a first input terminal, a second input terminal, and a first output terminal; and a second logic circuit comprising a third input terminal, a fourth input terminal, and a second output terminal, wherein an output signal of the second output terminal is inputted into the second input terminal, and an output signal of the first output terminal is inputted into the third input terminal.

7. The pixel circuit of claim 6, wherein the RS trigger further comprises:

a third logic circuit comprising a fifth input terminal, a sixth input terminal, and a third output terminal; and a fourth logic circuit comprising a seventh input terminal, an eighth input terminal, and a fourth output terminal, wherein signals of the same level are inputted into the sixth input terminal and the seventh input terminal, the third output terminal is connected to the first input terminal, and the fourth output terminal is connected to the fourth input terminal.

8. The pixel circuit of claim 7, wherein the third logic circuit and the fourth logic circuit each comprise an AND gate.

9. The pixel circuit of claim 6, wherein the first logic circuit and the second logic circuit each comprise a NOR gate.

10. A display device comprising:

a scan driver configured to generate a scan signal and apply the scan signal to at least one scan line;

a data driver configured to generate a data signal and apply the data signal to at least one data line;

an enable driver configured to generate an enable signal and apply the enable signal to at least one enable line;

a controller configured to control the scan driver, the data driver, and the enable driver; and at least one pixel circuit comprising:

an organic light emitting diode (OLED);

an RS trigger comprising a first terminal connected to a scan line, a second terminal connected to an enable line, and a third terminal connected to a data line, the RS trigger configured to generate an output signal according to an enable signal, a data signal, and a scan signal respectively received via the enable line, the data line, and the scan line; and a driving transistor comprising a first electrode connected to a first power source, a second electrode connected to an anode of the OLED, and a gate electrode connected to an output terminal of the RS trigger, the driver transistor configured to control a current flowing through the OLED in response to the output signal of the RS trigger, wherein the at least one pixel circuit is disposed between the at least one scan line, the at least one data line, and the at least one enable line.

11. The display device of claim 10, wherein the RS trigger is further configured to output the output signal according to signals respectively applied to the first terminal and the third terminal, when the enable signal of a first level is applied to the second terminal of the RS trigger.

12. The display device of claim 10, wherein the RS trigger is further configured to maintain a previous output signal when the enable signal of a first level is applied to the second terminal of the RS trigger, and signals of a second level are respectively applied to the first terminal and the third terminal.

13. The display device of claim 10, wherein the RS trigger is further configured to output a signal of low-level when the enable signal of a first level is applied to the second terminal of the RS trigger, and a signal of a second level is applied to the first terminal and a signal of the first level is applied to the third terminal.

14. The display device of claim 10, wherein the RS trigger is further configured to output a signal of a high level when the enable signal of a first level is applied to the second terminal of the RS trigger, and a signal of the first level is applied to the first terminal and a signal of a second level is applied to the third terminal.

15. The display device of claim 10, wherein the RS trigger further comprises:

a first logic circuit comprising a first input terminal, a second input terminal, and a first output terminal; and a second logic circuit comprising a third input terminal, a fourth input terminal, and a second output terminal, wherein an output signal of the second output terminal is inputted into the second input terminal, and an output signal of the first output terminal is inputted into the third input terminal.

16. The display device of claim 15, wherein the RS trigger further comprises:

a third logic circuit comprising a fifth input terminal, a sixth input terminal, and a third output terminal; and a fourth logic circuit comprising a seventh input terminal, an eighth input terminal, and a fourth output terminal, wherein signals of the same level are inputted into the sixth input terminal and the seventh input terminal, the third output terminal is connected to the first input terminal, and the fourth output terminal is connected to the fourth input terminal.

17. The display device of claim 16, wherein the third logic circuit and the fourth logic circuit each comprise an AND gate.

18. The display device of claim 15, wherein the first logic circuit and the second logic circuit each comprise a NOR gate.

* * * * *